US005154632A

United States Patent [19]

Ijiri

[11] Patent Number: 5,154,632

[45] Date of Patent: Oct. 13, 1992

[54] SHIELDED WIRE CONNECTOR

[75] Inventor: Tomaya Ijiri, Kameoka, Japan

[73] Assignee: Omron Corporation, Kyoto, Japan

[21] Appl. No.: 770,153

[22] Filed: Oct. 3, 1991

Related U.S. Application Data

[63] Continuation of Ser. No. 570,271, Aug. 20, 1990, abandoned.

[30] Foreign Application Priority Data

Aug. 20, 1989 [JP] Japan ..... 1-213972

[51] Int. Cl.[5] ..... H01R 4/24

[52] U.S. Cl. ..... 439/394; 439/410; 439/578

[58] Field of Search ..... 439/578, 585, 409–419, 439/607–610

[56] References Cited

U.S. PATENT DOCUMENTS 4,701,001 10/1987 Verhoeven ..... 439/394
4,701,137 10/1987 DeRoss .
4,708,414 11/1987 Lam ..... 439/394
4,759,722 7/1988 Song ..... 439/410

FOREIGN PATENT DOCUMENTS 0099008 1/1984 European Pat. Off. ..... 439/409
0310832 4/1989 European Pat. Off. ..... 439/410
2136638 9/1984 United Kingdom ..... 439/409

*Primary Examiner*—David L. Pirlot
*Attorney, Agent, or Firm*—Foley & Lardner

[57] ABSTRACT

A shielded wire connector comprising an electrically insulating connector body and a holder contiguous to the connector body through a pivot member and adapted to hold a shielded wire having a shield on its core wire securely in position, the connector body having a first and a second terminal member adapted to pierce into the shield and core, respectively, of the shielded wire when the holder holding the shielded wire is turned about the pivot member into direct engagement with the connector body.

15 Claims, 5 Drawing Sheets

SHIELDED WIRE CONNECTOR

This application is a continuation of application Ser. No. 07/570,271, filed Aug. 20, 1990, now abandoned.

BACKGROUND OF THE INVENTION

1. Field of the Invention

The present invention relates to a connector for a shielded wire having a shield on the peripheral surface of its core wire.

2. Brief Description of the Prior Art

For connection of an electrical part to the metal shield of the shielded wire, it is common practice to strip off the outermost sheath, divide the underlying part of the wire into the core wire and the braided metal sheath, strip off the core covering and connect the core wire and shield directly to the corresponding positions of the electrical part by soldering or by a press-on terminal means. It is obvious that this procedure involving stripping, division, soldering and/or the like is time-consuming and, hence, costly. Moreover, a special tool or apparatus is required for soldering or handling of the press-on terminal and unless the operator has adequate skill, the reliability of connection is sacrificed.

OBJECTS OF THE INVENTION

It is a primary object of the present invention to provide a shielded wire connector which is conducive to improved efficiency and reliability of wire connection.

Other objects and advantages of the invention will become apparent as the following description proceeds.

SUMMARY OF THE INVENTION

The novel shielded wire connector provided by the present invention comprises an electrically insulating connector body and a holder contiguous to said connector body through pivot means and adapted to hold a shielded wire having a shield on its core wire securely in position, said connector body having a first and a second terminal member adapted to pierce into said shield and core, respectively, of said shielded wire when the holder holding the shielded wire is turned about said pivot means into direct engagement with said connector body.

In accordance with the present invention, wherein the holder for holding a shielded wire firmly in position therein is contiguous to a connector body having a first and a second terminal member which are adapted to pierce into the shield and core wire, respectively, of said shielded wire for engagement therewith via an intervening pivot means, mere turning of said holder into direct engagement with said connector body results in a firm connection of the shielded wire with the consequent improvement in work efficiency and establishment of reliable connection without requiring any wire-connecting tool or apparatus.

BRIEF DESCRIPTION OF THE DRAWINGS

FIG. 5 is a perspective view showing the manner of connecting a shielded wire;

DETAILED DESCRIPTION OF THE PREFERRED EMBODIMENT

Figure 1:
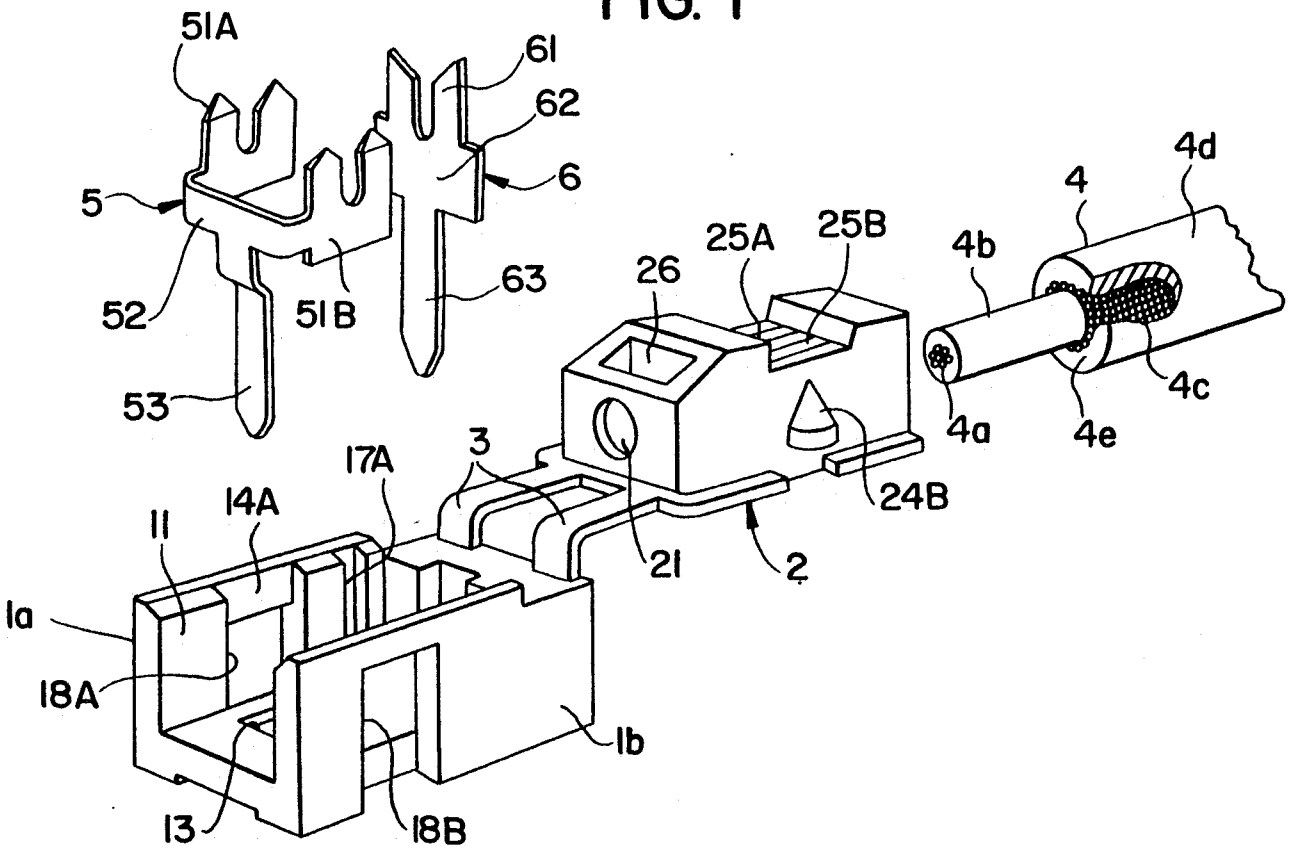
FIG. 1 is a disassembled perspective view showing a shielded wire connector embodying the principles of the invention.

Referring to FIG. 1 which is a disassembled perspective view illustrating a shielded wire connector embodying the principles of the invention, the connector generally comprises a connector body 1 made of an electrically insulating synthetic resin and a holder 2 made of an electrically insulating synthetic resin and contiguous to the rear end of said connector body 1 through a pivotal hinge means 3. The reference numeral 4 indicates a shielded wire which is held in position by said holder 2 and consists of a core wire 4*a*, a covering 4*b* for said core wire, a shield 4*c* sleaved over the outer periphery of said covering, and an outermost sheath 4*d* having an outer face 4*e* and being disposed externally of said shield. Indicated at 5 and 6 are a first and a second terminal member, both of which are secured to said connector body 1.

Figure 4A:
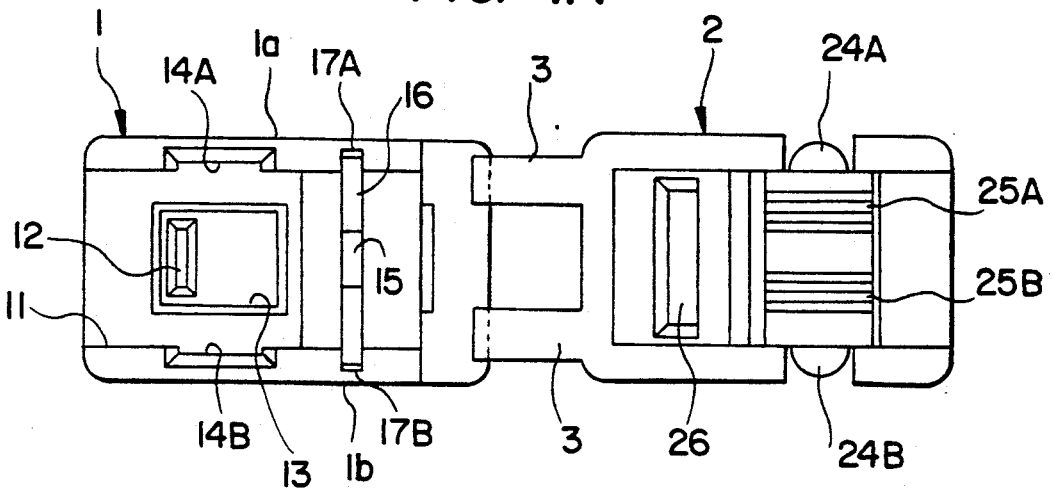
FIGS. 4*a* and 4*b* are a plan view and a cross-section view, respectively, of the connector body and holder of said connector.
Figure 4B:
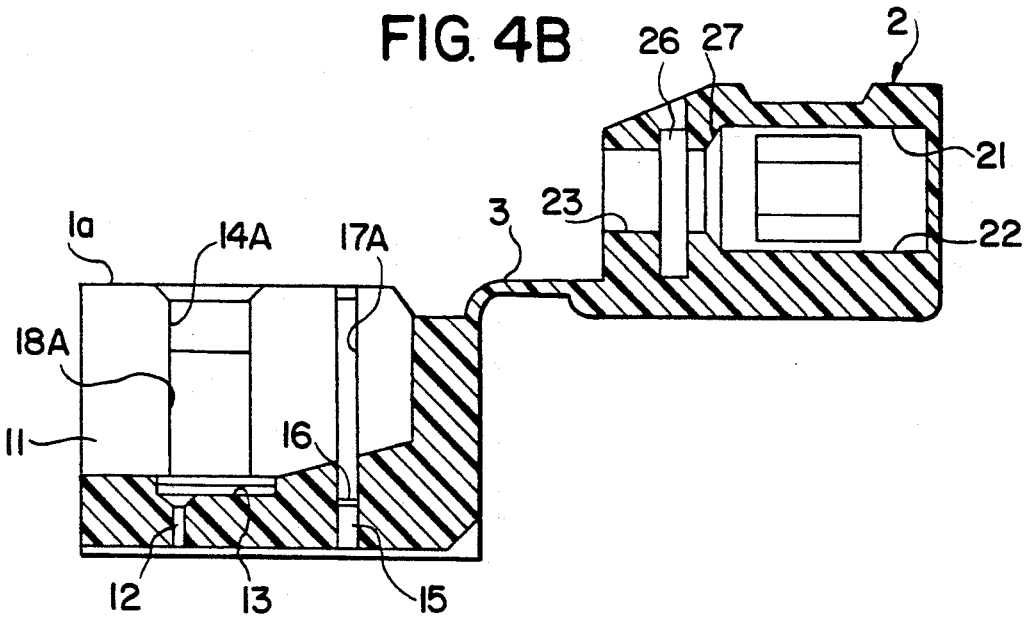

The connector body 1 has a recess 11 which is open at top and front and the bottom surface of which is formed with a first terminal member insertion hole 12 and a recessed setting means 13 as illustrated in FIGS. 4*a* and 4*b*. The inner surfaces of lateral walls 1*a* and 1*b* defining said recess 11 are formed with guide means 14A and 14B, respectively, for guiding engaging projections which are described in detail hereinafter. The above-mentioned bottom surface is formed, as disposed rearwardly of said setting means 13, with a second terminal member insertion hole 15 and a groove shaped setting means 16. Indicated at 17A and 17B are grooves formed on the inner surfaces of said lateral walls 1*a* and 1*b* for mating with and holding in position the second terminal member 6.

As shown in FIGS. 4*a* and 4*b*, the above-mentioned holder is formed with a through holding hole 21 extending from the rear surface to the forward surface thereof for holding the shielded wire inserted from the rear side. This through holding hole 21 consists of a large-diameter portion 22 engageable with said outer sheath 4*d* of the shielded wire 4 and a small-diameter portion 23 engageable with the core wire covering 4*b* so that the shielded wire 4 may be set in position, and a well portion 27. As illustrated in FIGS. 4*a* and 4*b*, the external surfaces on lateral sides of said holder 2 are formed with engaging projections 24A and 24B for engaging said engaging holes 18A and 18B of the connector body 1 on mating said holder 2 with said connector body 1.

Figure 5A:
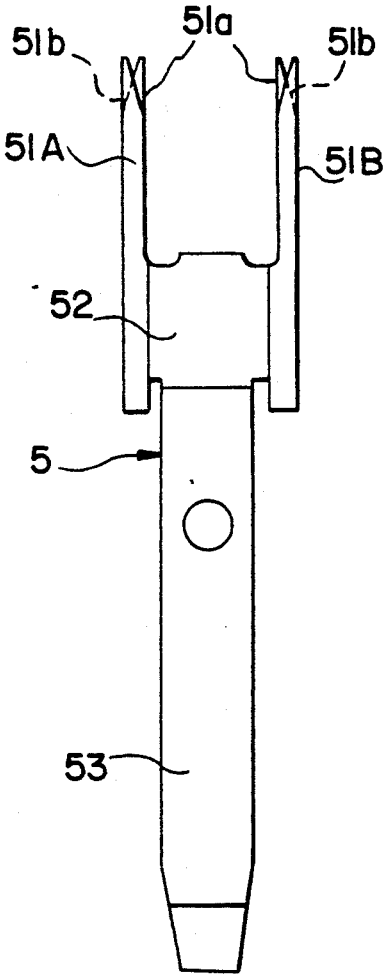
FIGS. 5*a* and 5*b* are a front view and a sectional side elevation view, respectively, which illustrate a first terminal member to be secured to said connector body.
Figure 5B:
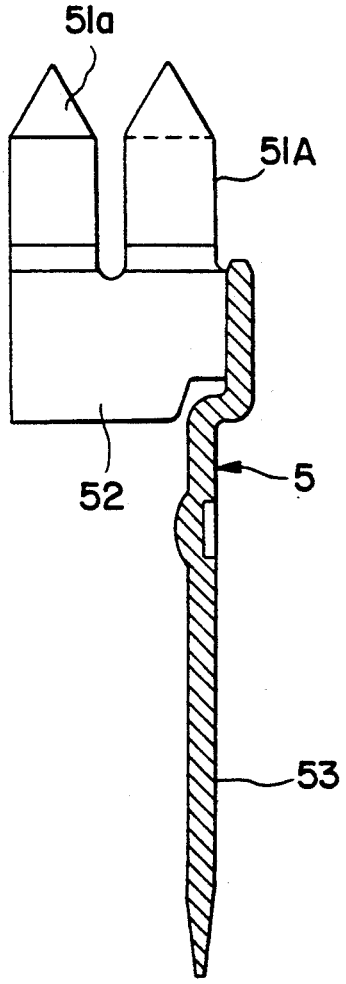

As illustrated in FIGS. 5*a* and 5*b*, the first terminal member 5 is bifurcated in the shape of a fork and consists of a pair of contactors 51A and 51B adapted to pierce into the shield 4*c* of said shielded wire 4, a trunk portion 52 holding said contactors 51A and 51B in fixed juxtaposed relation, and an external terminal 53 which is continual to said trunk portion 52. This external terminal 53 can be forced into said terminal member insertion hole 12 and locked in situ.

The second terminal member 6 mentioned hereinbefore is also bifurcated in the shape of a fork and consists of contactors 61 adapted to pierce into the core wire 4*a* of said shielded wire 4 in the radial direction thereof and an external terminal 63 continual to said contactors 61 via a trunk portion 62. This external terminal 63 can be forced into said second terminal member insertion hole 15 and locked in situ, while lateral ends of said trunk portion 62 are fitted into said grooves 17A and 17B and retained in position.

The reference numerals 25A and 25B indicate a first set of openings in said holder 2 for permitting the ingress of the contactors 51A and 51B of said first terminal member 5 in fitting the holder 2 to the connector body 1 and the reference numeral 26 indicates a second opening in said holder 2 for permitting the ingress of contactors 61 of said second terminal member 6 in fitting the holder 2 to the connector body.

The procedure for connecting said shielded wire 4 is described below.

As the forward end of the shielded wire 4 (FIG. 1) is inserted into the holding hole 21 from behind up to the position where it is visible from the front end opening, the core wire covering 4*b* of the shielded wire 4 is engaged with the small-diameter portion 23 while the outermost sheath 4*d* is engaged with the large-diameter portion. As a result, the shielded wire 4 is held in position by the holder 2 as indicated by a broken line in FIG. 2. The depth of insertion can be confirmed because the forward end of the shielded wire 4 is then visible from the front end of the holding hole 21.

Figure 2:
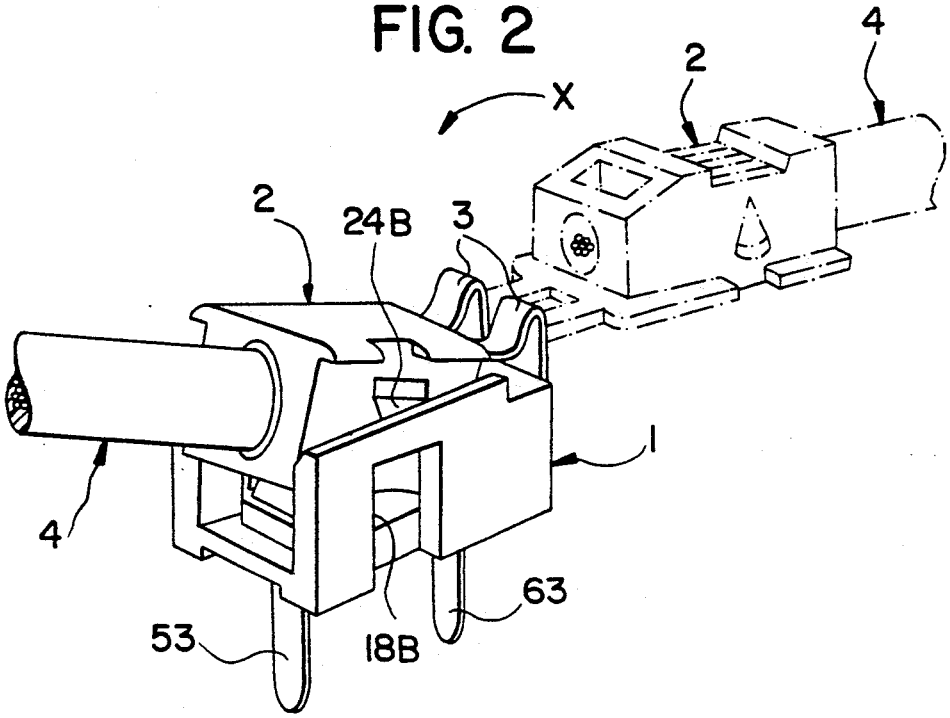
FIGS. 2 and 3 each is a schematic view illustrating the procedure of connecting a shielded wire to the above connector.
Figure 3:
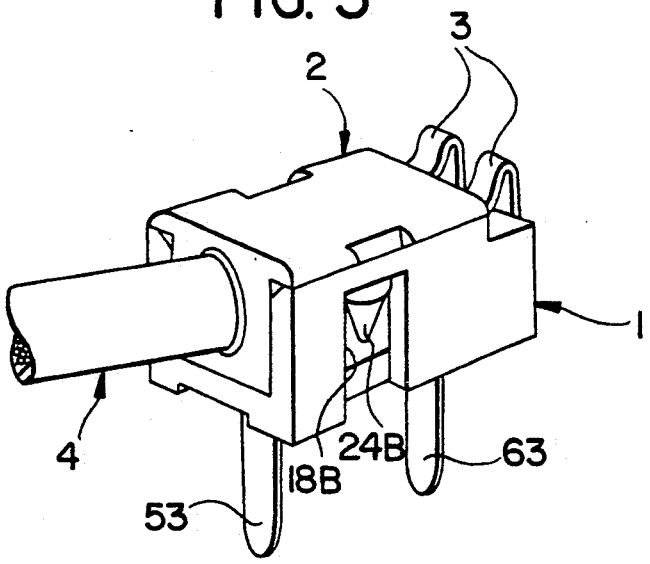

Then, the hinge members 3, 3 contiguous to said holder 2 are bent back to turn the holder 2 in the direction indicated by the arrowmark X in FIG. 2 and the holder 2 is then forced into the recess 11 of the connector body 1 as illustrated in FIG. 3. In this procedure, the engaging projections 24A and 24B of the holder 2 are brought into engagement with the engaging holes 18A and 18B, respectively, of the connector body 1 so that the two members 1 and 2 are firmly connected to each other. The engagement of said projections 24A and 24B with said holes 18A and 18B is smoothly accomplished with the aid of guides 14A and 14B.

Figure 6:
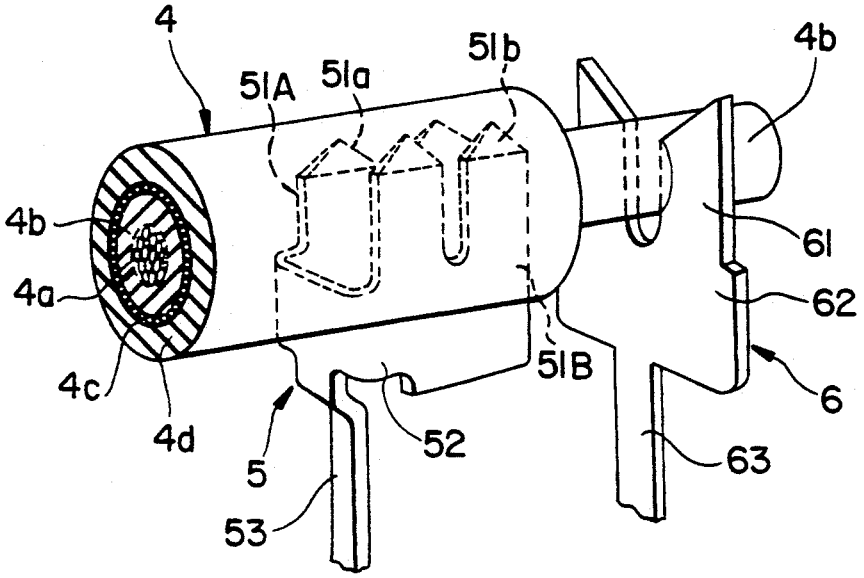
Figure 7:
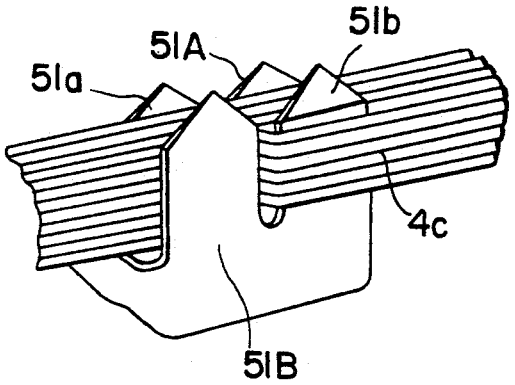
FIGS. 7 and 8 each is a schematic view illustrating the mode of connection.
Figure 8:
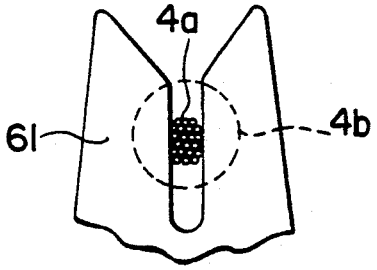

As the holder 2 is thus mated with the connector body 1, the contactors 51A and 51B of the first terminal member 5 pierce into the outermost sheath 4*d* of the shield wire 4 as illustrated in FIG. 6, whereby the shield 4*c* of the shielded wire 4 is brought into intimate contact with the contactors 51A and 51B. On the other hand, the contactors 61 of the second terminal member 6 pierce into the core wire covering 4*b* of the shielded wire 4 as illustrated in FIG. 6, with the result that the core wire 4*a* of the shielded wire 4 is brought into intimate contact with said contactors 61 as better seen in FIG. 8.

Thus, as the shielded wire 4 is inserted into the holder 2 and the latter is fitted into the connector body 1 by bending the hinge members 3 and 3 back, the shield 4*c* and core wire 4*a* of the shielded wire 4 are brought into contact with the first and second terminal members 5 and 6, respectively. Therefore, the shielded wire can be easily and positively connected without the need of soldering or without using a tool such as that required for press-on terminals, thus contributing considerably to the efficiency of wire connection. Furthermore, since the contactors 5 and 6 contact the shield 4*c* and core wire 4*a* with a fixed piercing force, positive connection is insured. Moreover, this connection is maintained stably because the holder 2 and the connector body 1 are secured to each other in fixed relation by the engagement of projections 24A and 24B with holes 18A and 18B.

Figure 9:
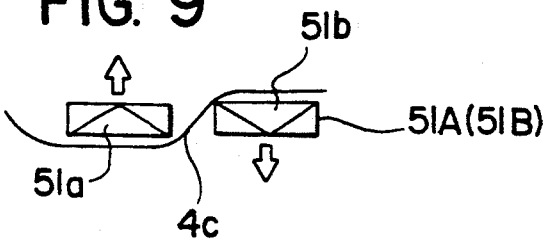
FIG. 9 is a schematic illustration of the effect produced by tapered surfaces of the contactors of the first terminal member.

It should be understood that while the contactors 51A and 51B may be in the shape of a plain fork, those in the above embodiment are respectively formed with tapered surfaces 51*a* and 51*b*, one of which is inclined inwardly with the other being inclined outwardly as illustrated in FIG. 5*a* so that when the contactor 51A (51B) pierces through the shield 4*c*, the shield is deformed inwardly and outwardly as indicated by the open arrowmarks in FIG. 9, with the resulting reaction assuring a still more positive connection.

The above description and the accompanying drawings are merely illustrative of the application of the principles of the present invention and are not limiting. Numerous other arrangements which embody the principles of the invention and which fall within its spirit and scope may be readily devised by those skilled in the art. Accordingly, the invention is not limited by the foregoing description, but is only limited by the scope of the appended claims.

What is claimed is:

1. A shielded wire connector comprising an electrically insulating connector body and a holder contiguous to said connector body through pivot means, said holder having a holding hole which receives and holds a shielded wire having a shield on its core wire, said connector body having a first and a second terminal member adapted to pierce into said shield and core, respectively, of said shielded wire when the holder holding the shielded wire is turned about said pivot means into direct engagement with said connector body wherein said first terminal member has first surface areas which contact said shield and said second terminal member has second surface areas which contact said core, said first surface areas being larger than said second surface areas, and wherein said holding hole comprises a large-diameter portion engageable with an outer sheath of the wire and a small-diameter portion engageable with a covering on the core so that the wire is set in position.

2. A shielded wire connection comprising:

a) an electrically insulating connector body member;

b) an electrically insulating holder member having a rear surface, a forward surface, and a holding hole extending from said rear surface to said forward surface;

c) the body member and the holder member being pivotally connected into and out of engagement with each other;

d) a first terminal in the body member for piercing the shield and a second terminal in the body member for piercing the core when the holder and body members are pivoted into engagement, and wherein the holding hole receives a wire therein, the wire having a shield and a core, and the holding hole comprises a large-diameter portion engageable with an outer sheath of the wire and a small-diameter portion engageable with a covering on the core so that the wire is set in position.

3. The connector of claim 2, wherein the body and holder are of synthetic resin.

4. The connector of claim 2, including openings in the holder member for receiving the terminals therein.

5. The connector of claim 2, including a hinge extending between and pivotally connecting the body and holder members together.

6. The connector of claim 5, wherein the hinge comprises a pair of thin elongated members.

7. The connector of claim 2, wherein the body member includes a recess being open at a top and a side, the recess receiving the holder member.

8. The connector of claim 7, including openings extending through the body member into the recess for receiving the first and second terminals.

9. The connector of claim 7, including projection means on one of the members and engaging holes on the other of the members to facilitate mating of the members.

10. The connector of claim 2, wherein the first terminal is bifurcated in the shape of a fork having a pair of contactors adapted for piercing into the shield of the wire.

11. The connector of claim 10, wherein the first terminal further includes a trunk portion joining the pair of contactors in a fixed juxtaposed relation and an external terminal portion extending from the body member.

12. The connector of claim 10, wherein there are four contactors on the first terminal.

13. The connector of claim 2, wherein the second terminal is bifurcated in the shape of a fork having a pair of contactors adapted for piercing into the core of the wire.

14. The connector of claim 13, wherein the second terminal further includes an external terminal continual with the contactors through a trunk portion and extending from the body member.

15. A method of connecting a shielded wire to a plurality of contactors, comprising:

a) pivotally joining an insulated body and a holder, b) inserting a shielded wire having a core and a shield into a holding hole in the holder, said holding hole having a large-diameter portion engageable with an outer sheath of the wire and a small-diameter portion engageable with a covering on the core, c) inserting contactor terminals into the body, d) pivotally inserting the holder into the body, and simultaneously piercing the core and shield with the contactor terminals.

* * * * *